US012577780B1

(12) United States Patent
Blois

(10) Patent No.: US 12,577,780 B1
(45) Date of Patent: Mar. 17, 2026

(54) MODULAR PANELS WITH GANGED SCREW ADJOINING FOR BUILDING CONSTRUCTION

(71) Applicant: Stanley Jonathan Blois, Parkland County (CA)

(72) Inventor: Stanley Jonathan Blois, Parkland County (CA)

( * ) Notice: Subject to any disclaimer, the term of this patent is extended or adjusted under 35 U.S.C. 154(b) by 0 days.

(21) Appl. No.: 19/328,042

(22) Filed: Sep. 12, 2025

(51) Int. Cl.
*E04C 2/52* (2006.01)
*E04C 2/00* (2006.01)

(52) U.S. Cl.
CPC ..... *E04C 2/526* (2013.01); *E04C 2002/001* (2013.01)

(58) Field of Classification Search
CPC .... E04C 2/526; E04C 2002/001; E04C 2/386; E04C 2/52; E04B 1/6183; E04B 1/34321; E04B 2001/327; A63H 33/107; A63H 33/067
See application file for complete search history.

(56) References Cited

U.S. PATENT DOCUMENTS

| | | | | |
|---|---|---|---|---|
| 5,785,478 | A | 7/1998 | Rotter et al. | |
| 6,253,530 | B1 | 7/2001 | Price et al. | |
| 11,084,245 | B2 * | 8/2021 | Kuhn | B32B 1/00 |
| 2001/0015045 | A1 | 8/2001 | Paroly | |
| 2002/0100235 | A1 | 8/2002 | Weiss | |
| 2004/0134162 | A1 | 7/2004 | Douglas | |
| 2005/0260296 | A1 * | 11/2005 | Sumrall | B28B 7/0014 425/219 |
| 2006/0110237 | A1 | 5/2006 | Belinda | |
| 2008/0041013 | A1 * | 2/2008 | Vetesnik | E04C 2/36 52/270 |
| 2016/0194864 | A1 | 7/2016 | Walker | |
| 2017/0022699 | A1 | 1/2017 | Lim | |
| 2018/0002915 | A1 * | 1/2018 | De Visscher | A63H 33/04 |
| 2019/0210317 | A1 | 7/2019 | Walker | |
| 2019/0218772 | A1 | 7/2019 | Tremblay | |
| 2020/0080297 | A1 | 3/2020 | Wright | |
| 2020/0215784 | A1 * | 7/2020 | Kuhn | B32B 1/00 |
| 2021/0025156 | A1 * | 1/2021 | Dombowsky | E04C 2/382 |
| 2021/0025163 | A1 | 1/2021 | Obanesian | |
| 2021/0060448 | A1 * | 3/2021 | Sullivan | A47B 47/047 |
| 2021/0131096 | A1 * | 5/2021 | Mordechai | E04B 1/32 |
| 2021/0207364 | A1 * | 7/2021 | Lee | E04C 2/34 |
| 2021/0222420 | A1 * | 7/2021 | Sato | E04B 1/2604 |
| 2021/0285214 | A1 * | 9/2021 | Moses | E04C 2/288 |

(Continued)

*Primary Examiner* — Gisele D Ford
(74) *Attorney, Agent, or Firm* — Workman Nydegger

(57) ABSTRACT

A modular panel has a box shape for forming a wall, floor, or roof section for constructing a building. The modular panel includes a ganged adjoining screw assembly (GASA) fixedly positioned inside of the modular panel and positioned on at least one side surface of the modular panel. Each GASA includes a plurality of adjoining screw assemblies (ASAs) and a torque limiting device configured to prevent overdriving the screw. Each ASA has a screw configured to penetrate the at least one side surface when rotated in one direction, fixedly attached to a top portion of the screw, and allowing rotational movements of the screw only inside the ASA. The modular panel further includes a penetration measuring device configured to measure an amount of penetration of the screw. The modular panel forms chaseways inside thereof for wires and pipes.

20 Claims, 12 Drawing Sheets

(56) References Cited

U.S. PATENT DOCUMENTS

| | | | | |
|---|---|---|---|---|
| 2021/0388612 | A1* | 12/2021 | Vivian | E04C 2/3405 |
| 2022/0064942 | A1 | 3/2022 | Inglese | |
| 2022/0220736 | A1* | 7/2022 | Rasmussen | E04B 2/60 |
| 2023/0020818 | A1* | 1/2023 | Corson | C09J 133/08 |
| 2023/0085070 | A1* | 3/2023 | Domschat | E04C 2/296 52/790.1 |
| 2023/0183975 | A1* | 6/2023 | Goulthorpe | E04C 2/521 52/220.2 |
| 2024/0018771 | A1 | 1/2024 | Lim | |
| 2024/0084593 | A1 | 3/2024 | Ohanesian | |
| 2024/0254789 | A1 | 8/2024 | Schofield et al. | |
| 2024/0417967 | A1* | 12/2024 | King | E04B 1/34321 |
| 2025/0250795 | A1* | 8/2025 | He | G09F 13/0446 |

* cited by examiner

MODULAR PANELS WITH GANGED SCREW ADJOINING FOR BUILDING CONSTRUCTION

BACKGROUND

Field of Invention

This invention relates to the construction of dwellings and other buildings using wood panels, and more particularly to Structural Insulated Panels (SIPs), Prefabricated Modular Panels (PMPs) or modular panels with ganged adjoining screws for building construction.

Description of the Related Art

Dwellings and other building structures have been constructed throughout recorded history. There have been many construction methods used including mud and straw bricks, joined logs, post and beam, steel, concrete, wood stud framed walls and truss roofs. Construction methods vary based on local materials, technology, available trade skills, climate, and a host of other factors. Ultimately the method is usually driven by the time, cost and effort required to complete the construction.

When a building is constructed, there are some steps to be taken including the following: financing, planning and design, utility connections, securing the land, site prep and grading, excavation, foundations, main floor construction, walls, ceilings, upper floors and walls, roof construction, doors and windows. Other work required is the installation of roofing material, insulation, wall and ceiling coatings, electrical, plumbing, and heating ventilation and air conditioning (HVAC) systems. Eventually, floor coverings, cabinets, and trim are installed as the building is completed. A major portion of a building's construction cost and effort is in the fabrication and erection of the floors, walls and ceilings on site.

Many buildings, especially dwellings and often commercial buildings, are made using stud walls with exterior sheathing of plywood or Oriented Strand Board (OSB). The exterior walls are constructed with a vapor barrier of a plastic film or composite paper, then insulated and finished on the wall interior with gypsum or drywall sheets. The exterior face will be finished with siding, stucco or heavy exterior paint. The interior face will be painted with interior paint.

A sequence of work is required during building construction. For example, before the interior drywall is installed, plumbers and electrical must install piping, wiring, HVAC ducts. Then the drywall is installed and painted. Then fixtures such as sinks, toilets, outlets, switches and lights are installed. This process requires the various trades workers to arrive at a certain point during the construction process, complete their work and leave the construction site. The building construction must be at a stage where they can start and complete their work. This requires significant coordination between the trades crews and ensuring that the site is ready for them to start working and that they have completed their work prior to leaving site so other trades can proceed. Extra site trips for the crews are expensive and to be avoided.

Roofing structures are similar with a frame or truss system with sheathing of plywood or OSB. Post and beam construction is also used but usually found to be more costly. As with wall construction, properly sequencing the work of the trades crews is a requirement.

BRIEF SUMMARY OF THE INVENTION

This present disclosure relates to Structural Insulated Panels (SIPs), Prefabricated Modular Panels (PM), or modular panels, which can be used for construction of dwellings and other buildings, that greatly reduces the number of steps required by conventional wood construction methods. Specifically, modular panels can be used to erect a structure faster and simpler than conventional construction, making the walls, floors, and roofs from dimensional lumber on site. The modular panels can be quickly attached to one another to form a complete building and are finished on the exterior and interior facing surfaces. Modified Accessory panels may be used in wall sections having preinstalled doors and windows. Thereby, the time required to erect a building ready to be occupied can be reduced.

According to various aspects, a modular panel has a box shape for forming a wall, floor, or roof section for constructing a building. The modular panel includes a ganged adjoining screw assembly (GASA) fixedly positioned inside of the modular panel and positioned on at least one side surface of the modular panel. Each GASA includes a plurality of adjoining screw assemblies (ASAs) and a torque limiting device configured to prevent overdriving the screw. Each ASA has a screw configured to penetrate the at least one side surface when rotated in one direction, fixedly attached to a top portion of the screw, and allowing rotational movements of the screw only inside the ASA. The modular panel further includes a penetration measuring device configured to measure an amount of penetration of the screw. The modular panel forms chase-ways inside thereof for wires and pipes.

In various aspects, a modular section for constructing a building includes a plurality of modular panels connected to each other to form a wall, floor, or roof section. Each modular panel has a box shape for forming a wall section for constructing a building. The modular panel includes a ganged adjoining screw assembly (GASA) fixedly positioned inside of the modular panel and positioned on at least one side surface of the modular panel. Each GASA includes a plurality of adjoining screw assemblies (ASAs) and a torque limiting device configured to prevent overdriving the screw. Each ASA has a screw configured to penetrate the at least one side surface when rotated in one direction, fixedly attached to a top portion of the screw, and allowing rotational movements of the screw only inside the ASA. The modular panel further includes a penetration measuring device configured to measure an amount of penetration of the screw. The modular panel forms chase-ways inside thereof for wires and pipes. Adjacent modular panels facing each other on respective side surfaces are fixedly connected to each other by screws of the GASA positioned on the respective surfaces.

Additional features and advantages will be set forth in the description which follows, and in part will be obvious from the description, or may be learned by practice. The features and advantages may be realized and obtained by means of the instruments and combinations particularly pointed out in the appended claims. These and other features will become more fully apparent from the following description and appended claims, or may be learned by the practice of the examples as set forth hereinafter.

BRIEF DESCRIPTION OF THE DRAWINGS

The features of the present disclosure are set forth with particularity in the claims that follow. A better understanding of the features and advantages of the present disclosure will be obtained by reference to the following detailed description that sets forth illustrative embodiments, in which the principles of the present disclosure are utilized, and the accompanying drawings.

DETAILED DESCRIPTION OF THE INVENTION

Figure 1A:
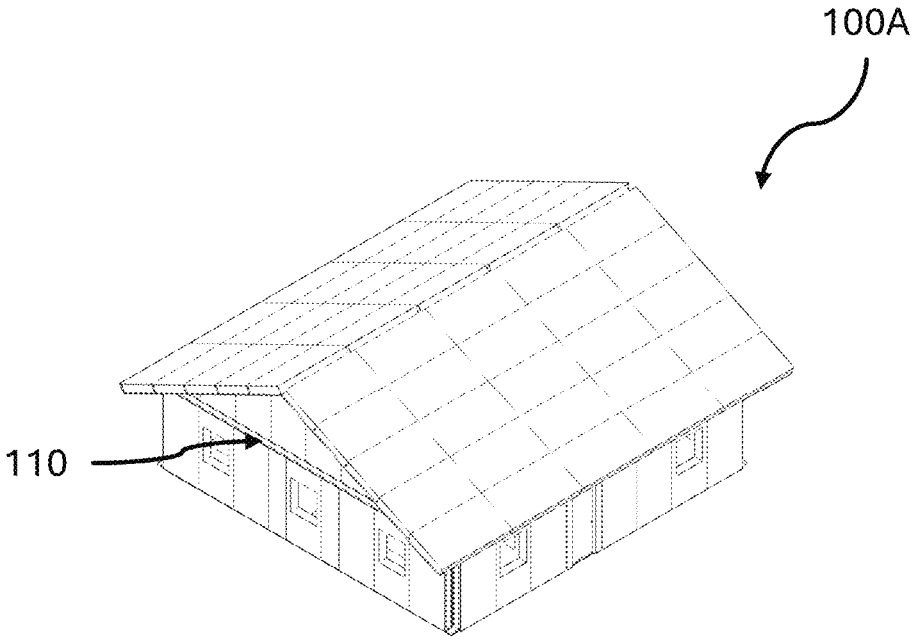
FIG. 1A illustrates a perspective view of a building formed with modular panels according to various aspects of the present disclosure.

Various aspects of the present disclosure generally relate to structural modular panels with a ganged adjoining screw assembly (GASA) adjoining for building construction. These modular panels may be used instead of conventional stud framing and sheathing. Other conventional modular panels may be faster and more efficient to use than conventional construction but usually have special installation requirements which generally preclude connecting to conventional construction methods. Modular panels disclosed in the present application allow integration with conventional construction methods while retaining the benefits of conventional modular panel construction. While modular panels are usually more costly, the added costs can be offset by significant savings in installation due to efficient and expedited construction. They are substantially finished on both inside and outside surfaces, and therefore may require less coordination effort and costs than those from additional crews, which are required to finish on site without using the modular panels.

In various aspects, description is made with reference to the figures. However, certain aspects may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order not to unnecessarily obscure the description. Reference throughout this specification to "one embodiment," "an embodiment," "an aspect," or the like, means that a particular feature, structure, configuration, or characteristic described is included in at least one embodiment. Thus, the appearance of the phrase "one embodiment," "an embodiment," "an aspect," or the like, in various places throughout this specification are not necessarily referring to the same embodiment or aspect. Furthermore, the particular features, structures, configurations, or characteristics may be combined in any suitable manner in one or more embodiments.

The use of relative terms throughout the description may denote a relative position or direction. For example, "distal" may indicate a first direction along a longitudinal axis of a modular panel. Similarly, "proximal" may indicate a second direction opposite to the first direction. Such terms are provided to establish relative frames of reference, however, and are not intended to limit the use or orientation of the modular panel to a specific configuration described in the various embodiments below unless otherwise identified.

Generally speaking, in conventional construction practices, the main floor must be erected with precision to ensure it is both level and flat. Wall sections are subsequently constructed and secured to the floor surface. Typically, wall sections are framed in a horizontal position on the floor deck, using a bottom plate and a top plate with vertical studs positioned between them. These framing components are fastened together using nails or screws. Sheathing is then applied to the framed wall section. Once assembled, the wall section is raised into position and affixed to the floor structure using mechanical fasteners such as nails or screws. Additional wall sections are constructed and installed in a similar manner, joined together to form the exterior walls and interior partitions which define the spatial layout of the building.

Floors are constructed using methods analogous to wall framing, except that instead of vertical studs, horizontal joists are utilized. These joists are spaced and supported to bear structural loads, with heavier decking materials placed on top to form a load-bearing surface. The floor assembly must be engineered to withstand applied loads without deflecting beyond the permissible limits set by applicable building codes. The load-bearing capacity of the floor system is determined by the size, spacing, and configuration of the joists, beams, or trusses. Likewise, the floor decking material must possess sufficient strength to support loads spanning between the structural members.

The conventional construction sequence described above typically requires several months to complete before the structure is suitable for occupancy. Progress is often constrained by weather conditions, and delays may arise due to late deliveries of materials or scheduling conflicts among subcontractors. These delays contribute to increased costs and project risk. One or more example embodiments seek to address these limitations by enabling accelerated construction timelines, thereby reducing overall project costs and risks.

While some builders fabricate wall framing off-site and transport pre-assembled wall sections to the construction site for installation, other manufacturers produce pre-finished panels incorporating proprietary connection systems. Although these prefabricated systems facilitate faster assembly, their joining techniques differ from the concealed or "blind" joining method employed in the present disclosure.

Certain pre-finished panels may include insulation between the panel faces. While such panels may provide adequate thermal performance for temperate climates, they are often insufficient for extreme temperature environments. One or more example embodiments incorporate insulation capable of meeting or exceeding the thermal performance requirements set forth in most building codes, ensuring suitability for a broad range of climatic conditions.

This present disclosure integrates multiple elements of building construction-namely, structural framing, thermal insulation, fire resistance, and interior and exterior finishes-into a unified modular panel system. Additionally, the present disclosure includes integrated chase-ways for plumbing and electrical utilities, further enhancing the efficiency and utility of the construction process. The basic modular panel of the present disclosure may be used to make a floor, wall or roof.

Furthermore, the use of prefabricated modular panels can significantly reduce construction costs and associated risks, thereby enabling a more efficient building process. Wall, floor, and roof assemblies may be pre-constructed at an off-site manufacturing facility by prefabricating the modular panels. These Prefabricated Modular Panels (PMP) can then be transported to the construction site and joined together to form the various sections of the new building structure, thereby accelerating the overall construction timeline and improving project efficiency.

Figure 1B:
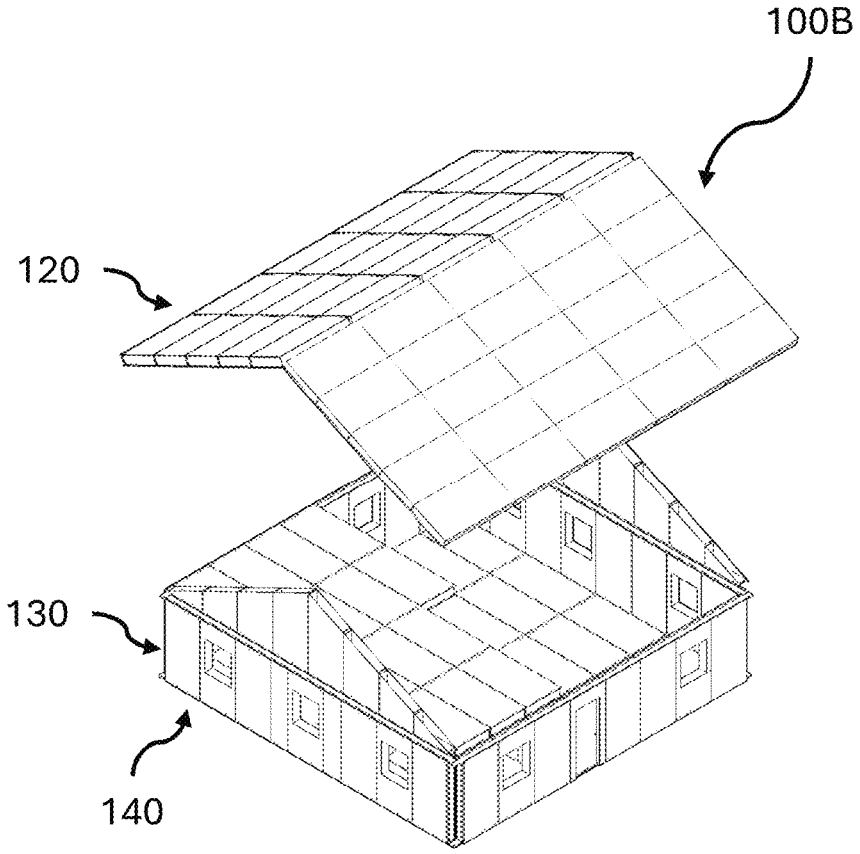
FIG. 1B illustrates an exploded view of the building of FIG. 1A according to various aspects of the present disclosure.

FIG. 1A illustrates a building 100A formed with modular panels 100 and FIG. 1B illustrates an exploded view of a building 110B according to various aspects of the present disclosure. The buildings 100A and 100B may include a roof 120, side walls 130, and main floors 140.

When horizontal joists are installed, modular panels may be assembled together over and/or between the horizontal joists to form the main floor 140. The modular panels may be prefabricated and/or assembled at the factory and delivered to the construction site for installation. Due to the inherent characteristics of the prefabricated modular panels, the main floor 140 assembled by the modular panels may be leveled and flat.

Figure 2:
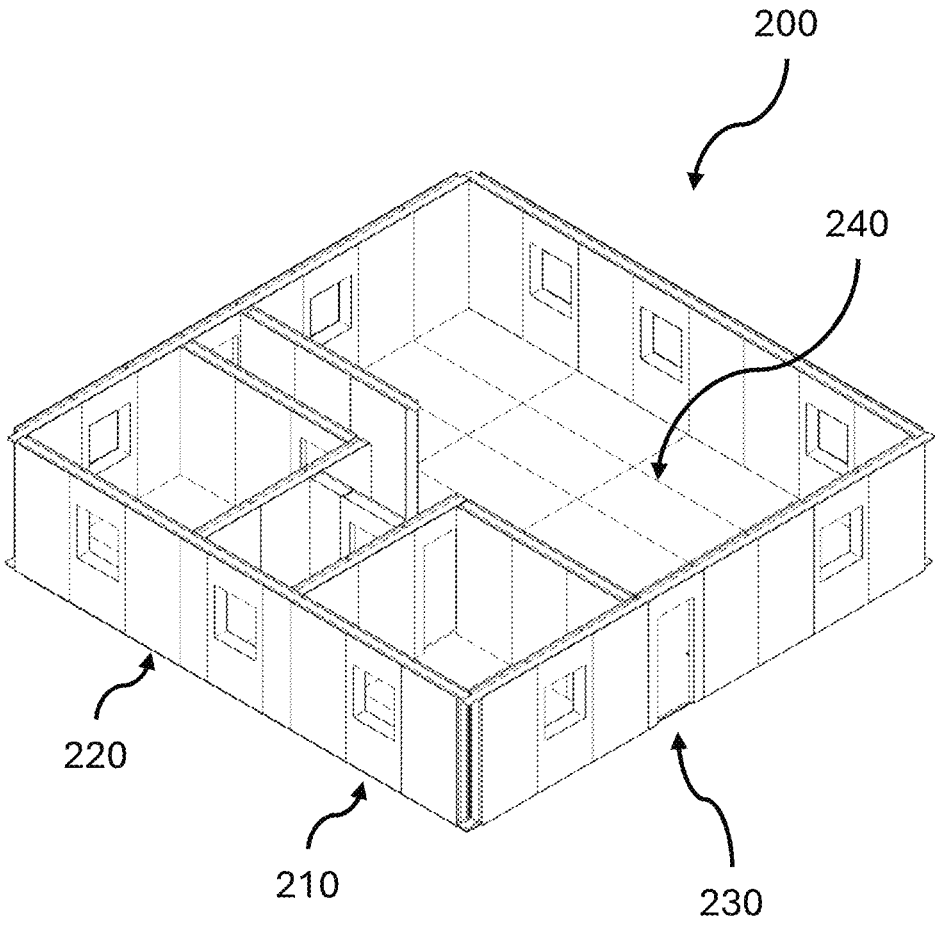
FIG. 2 illustrates a perspective view of one floor of the building of FIG. 1A according to various aspects of the present disclosure.

Now turning attention to FIG. 2, illustrated is a perspective view 200 of side walls according to various aspects of the present disclosure. As illustrated, the side walls are made with adjoined basic prefabricated modular panels (PMP) 220, accessory modular panels 210 with pre-installed windows, and accessory modular panels 230 with doors. The basic modular panels 220 may form the floor 240. The basic prefabricated modular panel 220 may be based on the North American construction standard of a 4 feet by 8 feet sheet. This size of the prefabricated modular panel 220 may be a different size depending on the market demands and regional needs. For example, a modular panel for a European or Asian project may be based on metric standard sizing. The basic modular panel 220 in uniform size may be manufactured on a high volume production line. In an aspect, customized accessory modular panels 210 and 230 may be made to meet specific needs based on various shapes, sizes, situations, and features, and may be fabricated in a manufacturing facility equipped for such production.

Based on a blueprint of a building, the number of basic modular panels 220 and accessory panels 210 and 230, which are needed to accommodate walls with windows and doors, respectively, may be predetermined. Manufacturers may be able to prefabricate accessory modular panels 210 and 230 in different sizes and pre-assemble them in various shapes at their manufacturing sites and deliver them to the building site. Construction workers may then be able to set up the walls with the basic modular panels 220 and the accessory modular panels 210 and 230 with pre-installed windows and doors into the corresponding sections of the building. Specific details of the basic modular panel 220 can be found below.

A. Aspects of Modular Panel

Figure 3A:
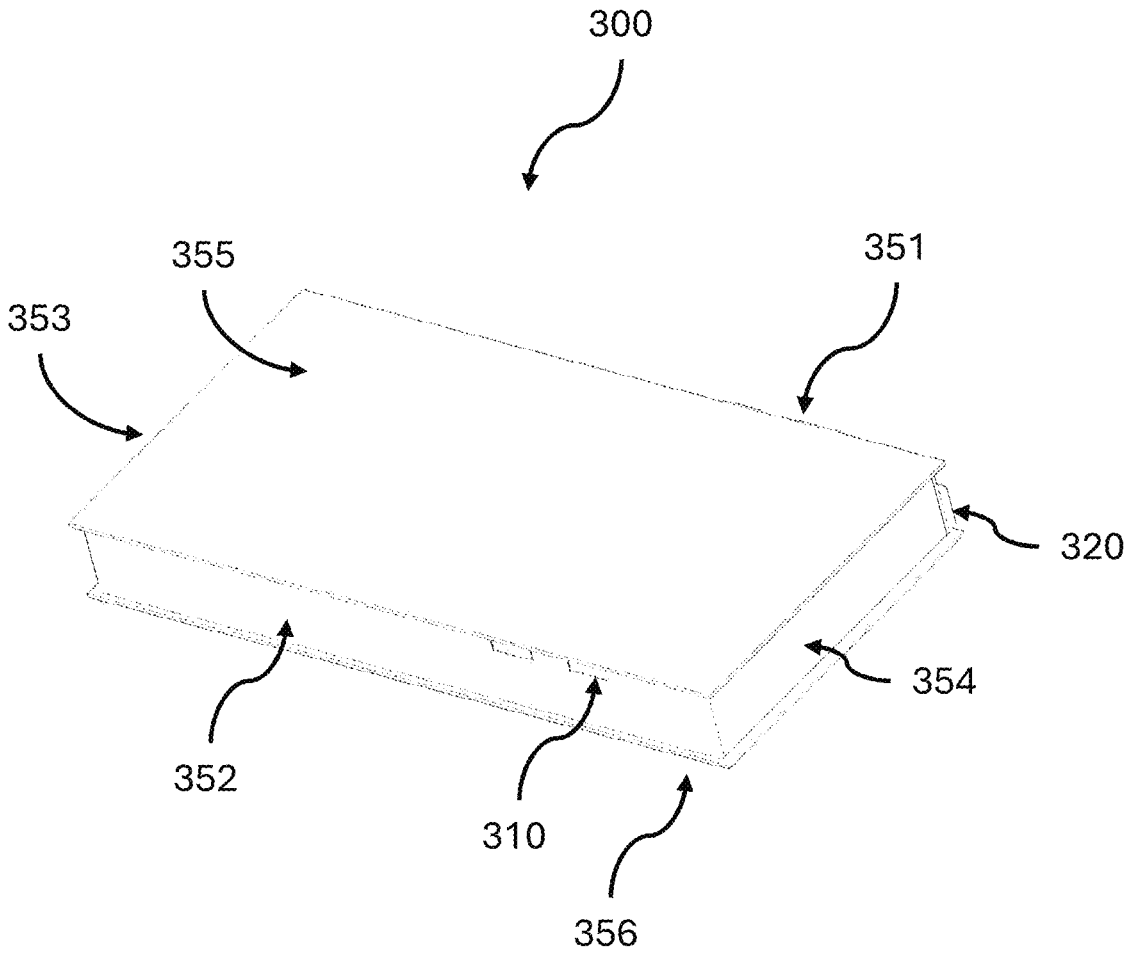
FIG. 3A illustrates a perspective view of a modular panel according to various aspects of the present disclosure.

Turning now to FIG. 3A, illustrated is a perspective view of an individual modular panel 300 according to various aspects of the present disclosure. The modular panel 300 may include all six side surfaces: the right side surface 351, the left side surface 352, the top side surface 353, the bottom side surface 354, the front surface 355, and the back surface 356. Each side surface 351-356 may be formed from wood, metal, composite, or engineered materials, which are able to provide sufficient horizontal and vertical strength to resist bending.

These surfaces 351-356 may form a sheathing for the modular panel 300, and when modular panels 300 are assembled to form a section on site for erecting walls, floors, or roofs, such assemblies may provide further structural support and resilience from bending. Further, the modular panel 300 may be coated with a fire resistant material. In an aspect, the inside surfaces of the modular panel 300 may be coated with a vapor seal.

The modular panel 300 may include internal chase-ways 310 for electrical wiring and for plumbing running horizontally. When the modular panels 300 are interconnected, the chase-ways 310 may be aligned, allowing a contiguous path for wires and/or piping inside the wall. The pre-made chase-ways 310 may facilitate installing utilities after the modular panels are installed.

In various aspects, an interconnecting modular panels may be manufactured in a way to form chase-ways from the top or bottom surface to the side surface so that wires or pipes may be inserted into the horizontally aligned chase-ways 310 of the modular panels 300 from the top or bottom surfaces of the interconnecting modular panels.

The modular panel 300 may have sealing coat of closed cell foam insulation inside the exterior side surfaces providing a vapor barrier and added structural support. Other insulation types, such as cellulose or fiberglass, may be used to fill the entire interior space of the modular panel 300, thereby increasing the insulation value, R. The number of chase-ways 310 in the modular panel 300 may be one, two, or more than two.

The position of the chase-ways 310 may be, for example, set at a predetermined height from the floor to meet building code and best building practices to place electrical outlets and sink shutoff valves.

In an aspect, the positions of the chase-ways 310 may be on a predetermined position, which is lower or upper side with respect to the center of the vertical side surface. With this configuration, the top and bottom surfaces need to be matched so that contiguous horizontal chase-ways 310 may be formed.

An adjoining screw assembly (ASA) may be attached to a piece of conventional, dimensional lumber 320, such as a 2"×6", 2"×8", 2"*10", or the likes, that can be used to adjoin two structural panels or transition to or from conventional construction method. Similarly, this would be applicable for adjoining on the top or bottom plates. The dimensional lumber 320 may be attached at one, two, or three side surfaces of the modular panel 300 at a manufacturing factory, thus saving that work on site.

In a case where the dimensional lumber 320 is positioned in a way to cover the chase-ways 310, portions of the dimensional lumber 320, which correspond to the chase-ways 310, may be removed or cut away so that the chase-ways 310 are not blocked by the dimensional lumber 320.

In an aspect, when the right side surface 351 of a first modular panel 300 is adjoined via the dimensional lumber 320 to the left side surface 352 of a second modular panel 300, the front and back surfaces 355 and 356 may be extended over the left and right side surfaces 351 and 352 by one inch so that, when they are adjoined, the front and back surfaces 355 and 356 may cover the dimensional lumber 320.

On the other hand, the front and back surfaces 355 and 356 of the modular panel 300 may be extended toward the bottom side surface 354 by two inches so that, when the modular panel 300 is installed on a bottom floor, a dimensional lumber 320 may be attached to the bottom floor and the bottom side surface 354 cover the dimensional lumber 320. In this configuration, the front and back surfaces 355 and 356 of the modular panel 300 may not be extended toward the top side surface 353.

In a case where a second modular panel 300 is adjoined over a first modular panel 300, the front and back surfaces 355 and 356 of the second modular panel 300 may cover the dimensional lumber 320 between the bottom side surface 354 of the second modular panel 300 and the top side surface 353 of the first modular panel 300.

In another aspect, when the right side surface 351 of the first modular panel 300 is adjoined via the dimensional lumber 320 to the left side surface 352 of the second modular panel 300, the front and back surfaces 355 and 356 may be extended over the right side surface 351 by two inches and may not be extended over the left side surface 352. Thus, when they are adjoined, the front and back surfaces 355 and 356 may cover the dimensional lumber 320.

In still another aspect, when the dimensional lumber 320 has a different dimension, the front and back surfaces 355 and 356 may be extended over the left and right side surfaces 351 and 352, respectively, by one half of the thickness of the dimensional lumber 320, and the front and back surfaces 355 and 356 may be extended over the bottom side surface 354 by the thickness of the dimensional lumber 320 and may not be extended over the top side surface 353.

Figure 3B:
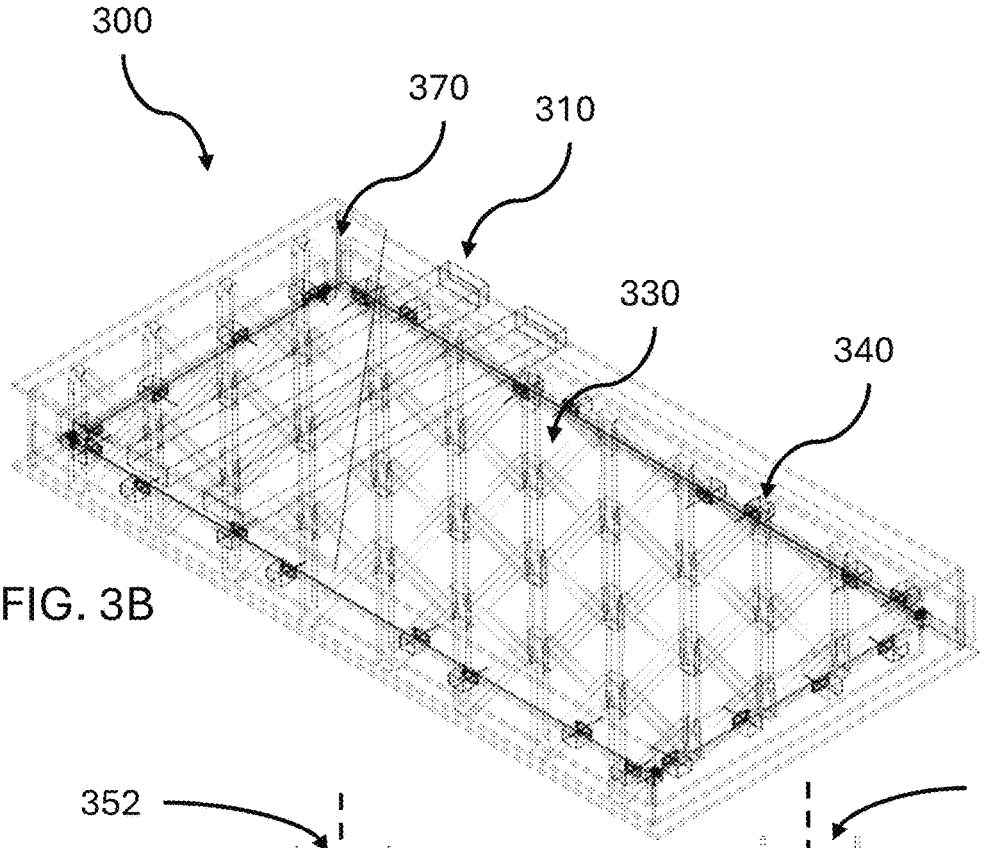
FIG. 3B illustrates a wireframe structural view of a modular panel according to various aspects of the present disclosure.

Now turning to FIG. 3B, illustrated is a wireframe structural view of the modular panel 300 of FIG. 3A according to various aspects of the present disclosure. The modular panel 300 may further include a space-frame truss system 330, which provides structural support evenly across the six side surfaces suitable for either use as a wall, floor, or roof section. The space-frame truss system 330 may be made from straight members arranged in connected triangles and designed to support loads efficiently over the side surfaces of the modular panel 300. The modular panel 300 may include fire resistant coatings on the outside, inside, or the space-frame truss system 330.

On the truss side of the exterior face of the modular panel 300 may be finished with insulation material and vapor seal. Thus, no other finishing is needed except small penetration holes 510 as described below with respect to FIG. 5. The modular panel 300 may be made of plywood and dimensional lumber. In aspects, a composite board of paper and fabric may form the modular panel 300 instead of plywood sheets, provided that material strengths, durability, and consistency are maintained comparable to plywood sheets. Similarly, the space-frame truss system 330 may be made from bamboo or fibrous tubes instead of the dimensional lumber.

The shape of the space-frame truss system 330 may be square pyramids, tetrahedron, or any other shape that can provide sufficient structural support.

The modular panel 300 may further include ganged adjoining screw assembly (GASA) 340 inside thereof. The GASA 340 may be positioned along the right, left, top, and bottom side surfaces 351-354. In other words, screws in the GASA 340 may penetrate the right, left, top, and bottom side surfaces 351-354 to respective dimensional lumbers 320 so as to adjoin adjacent modular panels 300.

For example, when the first modular panel 300 is fixed to the floor by using the GASA 340 positioned in the bottom side surface 354 and the second modular panel 300 is to be adjoined to the first modular panel 300 from the right side, the GASA 340 positioned in the left side surface 352 of the first modular panel 300 and the GASA 340 positioned in the right side surface 351 of the second modular panel may be used to adjoin them together via the dimensional lumber 320 positioned therebetween.

The number of ASAs in a GASA 340, which are positioned on the shorter or horizontal side surface (e.g., the top and bottom side surfaces 353 and 354) may be different than the number of ASAs in the GASA 340, which are positioned on the longer or vertical side (e.g., the right and left side surfaces 351 and 352). The number of ASAs present on a GASA 340 may vary depending on the length of the panel side.

B. Aspects of GASA

Figure 3C:
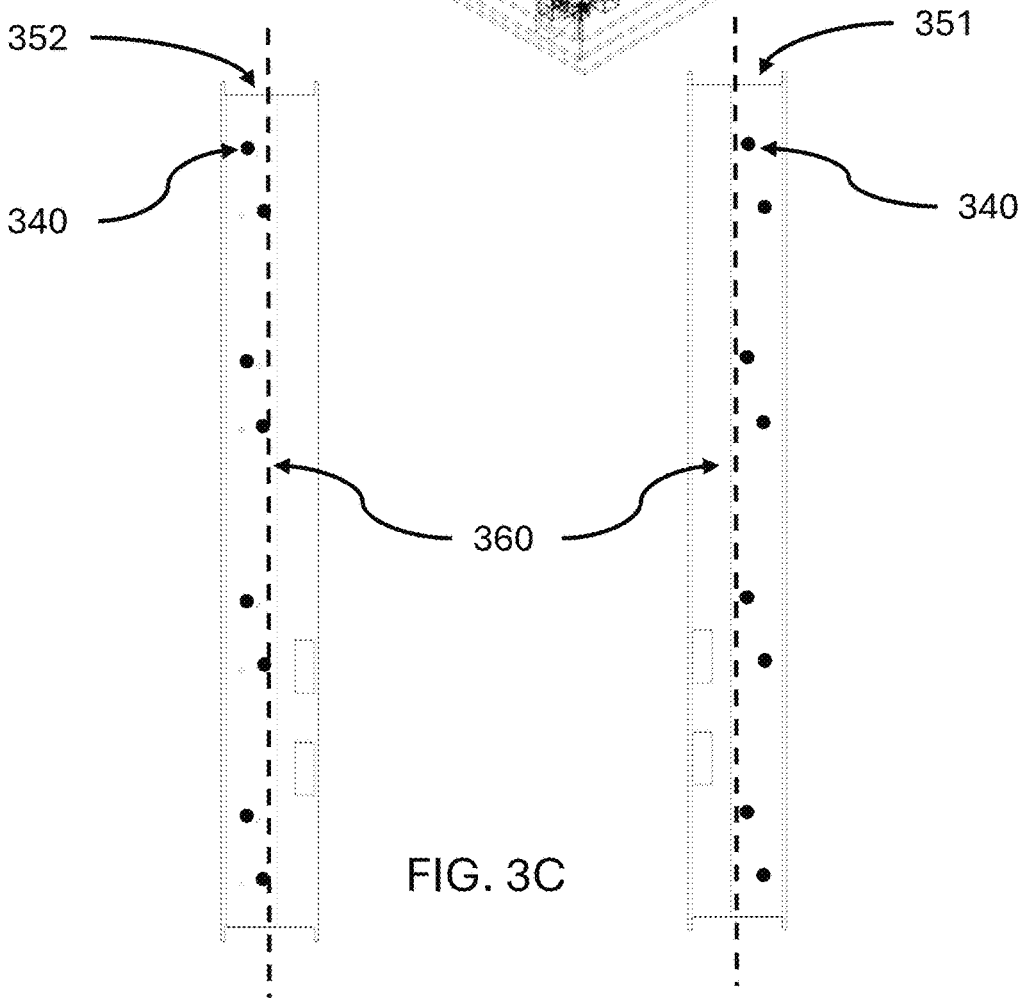
FIG. 3C illustrates graphical illustrations showing positional relationships of ganged adjoining screw systems on opposite side surfaces according to various aspects of the present disclosure.

Turning now to FIG. 3C, illustrated are graphical illustrations showing positional relationships of GASA 340 on opposite side surfaces according to various aspects of the present disclosure. For example, the left side surface 352 of the first modular panel 300 and the right side surface 351 of the second modular panel 300 may face each other or positioned on the opposite side when the first and second modular panels 300 are adjoined.

To clearly show positions of the GASAs 340 of the modular panel 300, a central line 360 is drawn in dotted lines on the right and left side surfaces 351 and 352. The GASA 340 positioned on the left side surface 352 may be positioned on the left side with respect to the central line 360, while GASA 340 positioned on the right side surface 351 may be positioned on the right side with respect to the central line 360. With this configuration, when the first and second modular panels 300 are to be adjoined via the dimensional lumber 320, the right side surface 351 of the first modular panel 300 positioned in the left side faces the left side surface 352 of the second modular panel 300 positioned in the right side. In other words, the GASA 340, which is positioned in the right side surface 351 of the first modular panel 300 and positioned in the left side with respect to the central line 360, is used to adjoin the second modular panel 300, and the GASA 340, which is positioned in the left side surface 352 of the second modular panel 300 and positioned in the left side with respect to the central line 360, is used to adjoin the first modular panel 300. Since each side surface is adjoined with the GASAs 340 positioned in both sides with respect to the central line 360, the two modular panels 360 may be mechanically attached to one another via the dimensional lumber 320.

C. Aspects of ASA

Figure 4:
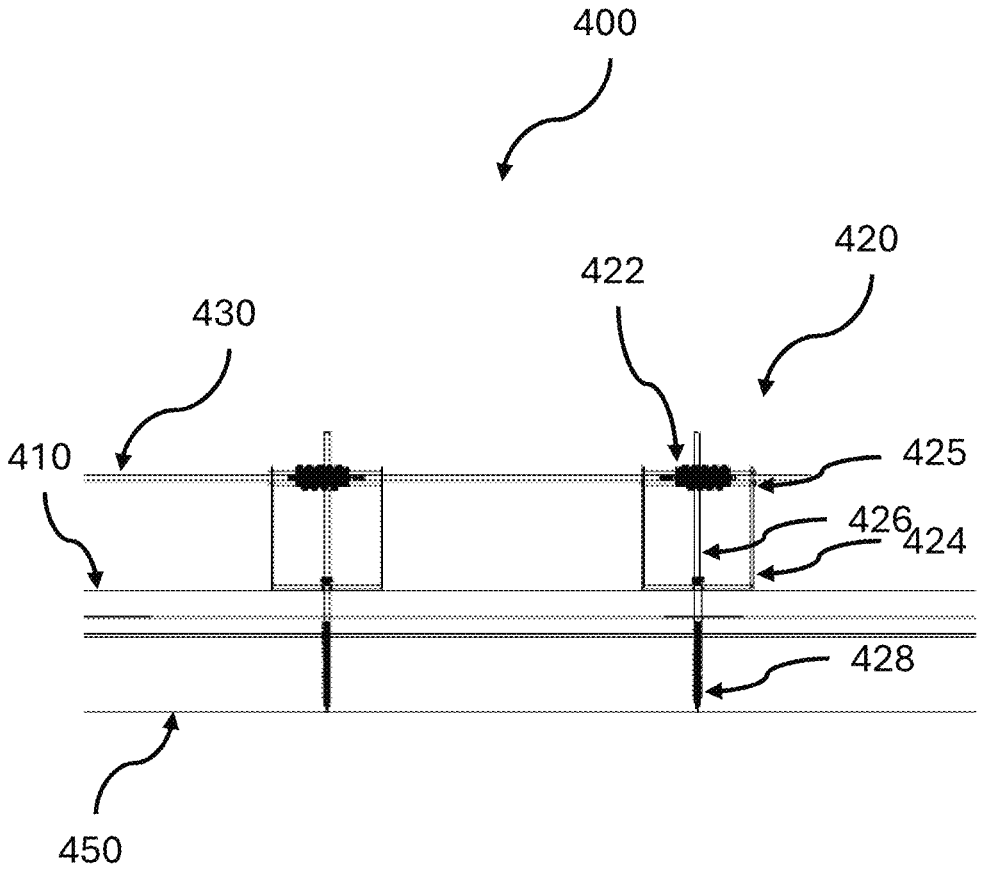
FIG. 4 illustrates adjoining screws installed inside of a modular panel according to various aspects of the present disclosure.

Now turning to FIG. 4, illustrated is exemplary of adjoining screws 428 installed inside of a GASA 400 according to various aspects of the present disclosure. The GASA 400 may include an ASA 420 and a common shaft 430. The ASA 420 may be positioned on the inner side surface mounting strip 410 of a modular panel (e.g., the modular panel 300 of FIG. 3A).

Within the ASA 420, a gear mechanism 422 may be rotated by the common shaft 430. Specifically, the rotational motion of the common shaft 430 along the horizontal axis may be translated to rotational motions along the vertical axis via the gear mechanism 422.

The ASA 420 may further include a screw 428 and a screw shaft 426. The screw 428 may be fixedly fastened to the screw shaft 426. The ASA 420 may be enclosed by a cage 424, which provides structural support for the gear mechanism 422 and the screw 428. Specifically, the screw shaft 426 may be enclosed by the cage 424 and rotate within the cage 424. The screw shaft 426 may be also fixedly attached to the head of the screw 428. The gear mechanism 422 may be mechanically connected to the screw shaft 426 so that, when the gear mechanism 422 rotates around the vertical axis, the screw shaft 426 is correspondingly rotated, thereby, rotating the screw 428. The rotation of the screw 428 enables the screw 428 to penetrate a side surface and into a side surface of a dimensional lumber 450 in turn attached to another modular panel or conventional construction. The gear mechanism 422 may be a spur gear, which is held in position by the cage 424 and a retainer 425.

In a case when the common shaft 430 rotates in another direction, the screws 428 may be withdrawn from the corresponding dimensional lumber 450. The common shaft 430 may be connected to a plurality of ASAs 420. Thus, with the rotational movements of the common shaft 430, one or more screws 428 may be able to penetrate the side surface and adjoin the corresponding dimensional lumber 450.

Figure 5:
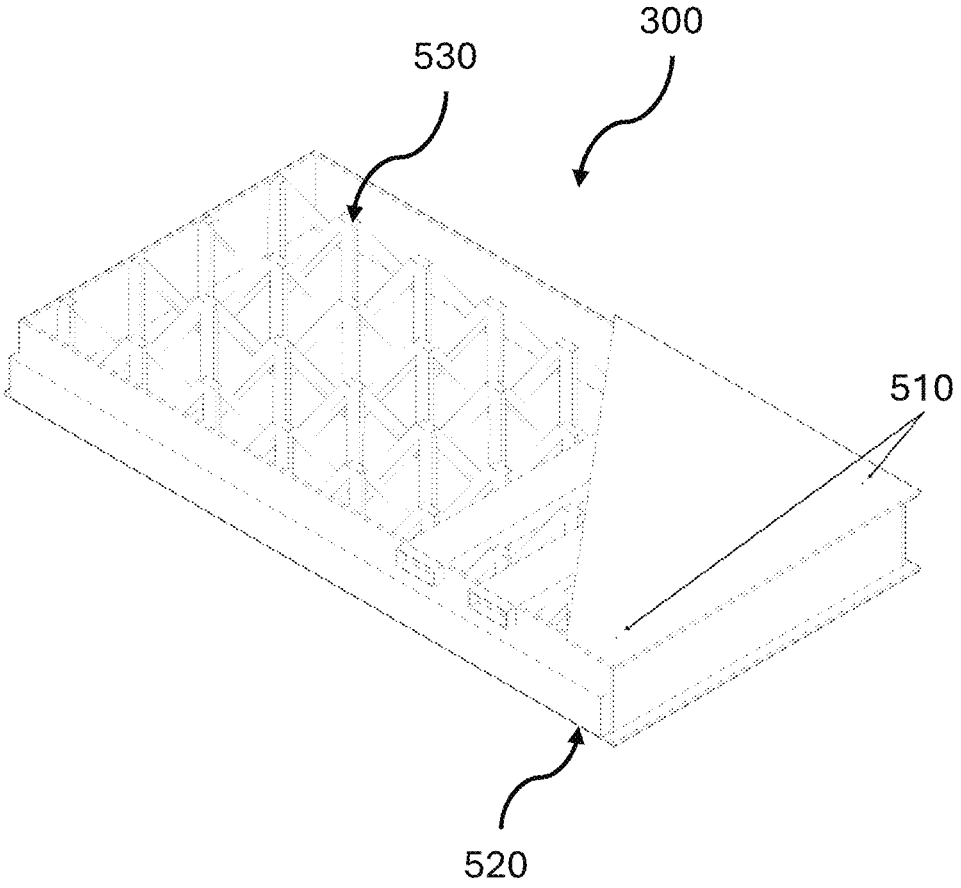
FIG. 5 illustrates a cutaway view of the modular panel showing an internal truss system and electrical/mechanical chase-ways according to various aspects of the present disclosure.
Figure 6:
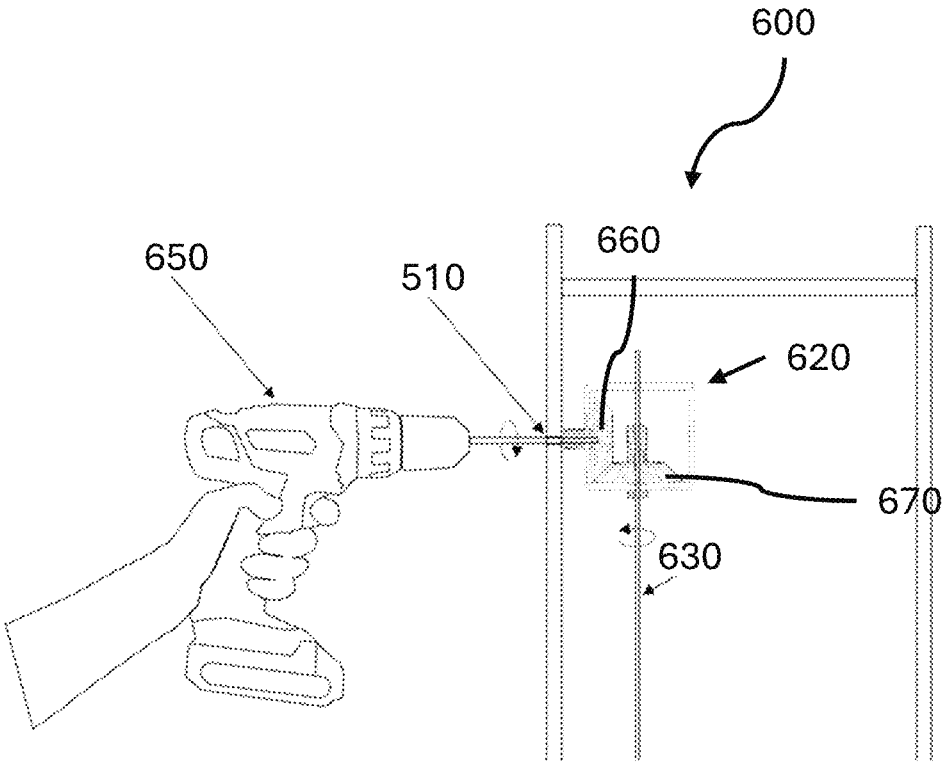
FIG. 6 illustrates a graphical illustration of a gear mechanism for a screw according to various aspects of the present disclosure.

With reference to FIGS. 5 and 6, the common shaft 630 may be rotated along a longitudinal direction of the common shaft 630 by a rotating tool 650, as illustrated in FIG. 6, and the rotating tool 650 may be inserted into a penetration hole 510, as illustrated in FIG. 6, so that the rotating tool 650 can be mechanically coupled with the common shaft 630. The penetration hole 510 may form through the front surface (e.g., the front surface 355 of FIG. 3).

In an aspect, the penetration holes 510 may be positioned near the corners of the front surface. In this case, four common shafts 630 may be installed on the right, left, top, and bottom side surfaces (e.g., the right, left, top, and bottom side surfaces 351-354 of FIG. 3).

In another aspect, the number of ASAs 420 on the long side (e.g., the right and left side surfaces 351 and 352 of FIG. 3) may be greater than the number of ASAs 420 on the short side (e.g., the top and bottom side surfaces 353 and 354 of FIG. 3).

In still another aspect, the ASAs 420 on the long side may be grouped into two or more groups and the corresponding two or more common shafts are disposed on the long side such that each group of ASAs 420 may be connected to a respective common shaft 630, which can be rotated by a rotating tool 650 inserted into a respective penetration hole 510. In this configuration, the number of penetration holes 510 on the long side may correspond to the number of common shafts on the long side.

Now returning back to FIG. 6, illustrated is a common shaft drive assembly 600, which includes a gear box cage 620, which may be a bevel gear assembly. Within the gear box cage 620, a first gear mechanism 660 may be positioned under a respective penetration hole 510 and in the corner of the front surface and a second gear mechanism 670 may be positioned in the longitudinal direction of the common shaft 630. When a tip of the rotating tool shaft of the rotating tool 650 is inserted into the penetration hole 510, the tip of the rotating tool shaft may be mechanically connected with the first gear mechanism 660. The first gear mechanism 660 may be mechanically connected with the second gear mechanism 670 in a way that, when the first gear mechanism 660 rotates around a longitudinal axis of the rotating tool shaft, the second gear mechanism 670 rotates around the longitudinal axis of the common shaft 630, where the longitudinal axis of the rotating tool shaft is shown in the horizontal direction and the longitudinal axis of the common shaft 630 is shown in the vertical direction in FIG. 6. Further, the second gear mechanism 670 may be fixedly connected with the common shaft 630 so that, when the second gear mechanism 670 rotates around the vertical direction, the common shaft 630 likewise rotates around the longitudinal axis of the common shaft 630.

In an aspect, other types of gear mechanisms may also be applied to the first and second gear mechanisms 660 and 670 as far as the rotation around a first direction is translated into the rotation around a second direction, which is perpendicular to the first direction. Each GASA 400 in each side surface may have a respective common shaft drive assembly 600.

D. Aspects of Torque Limiter

Figure 7:
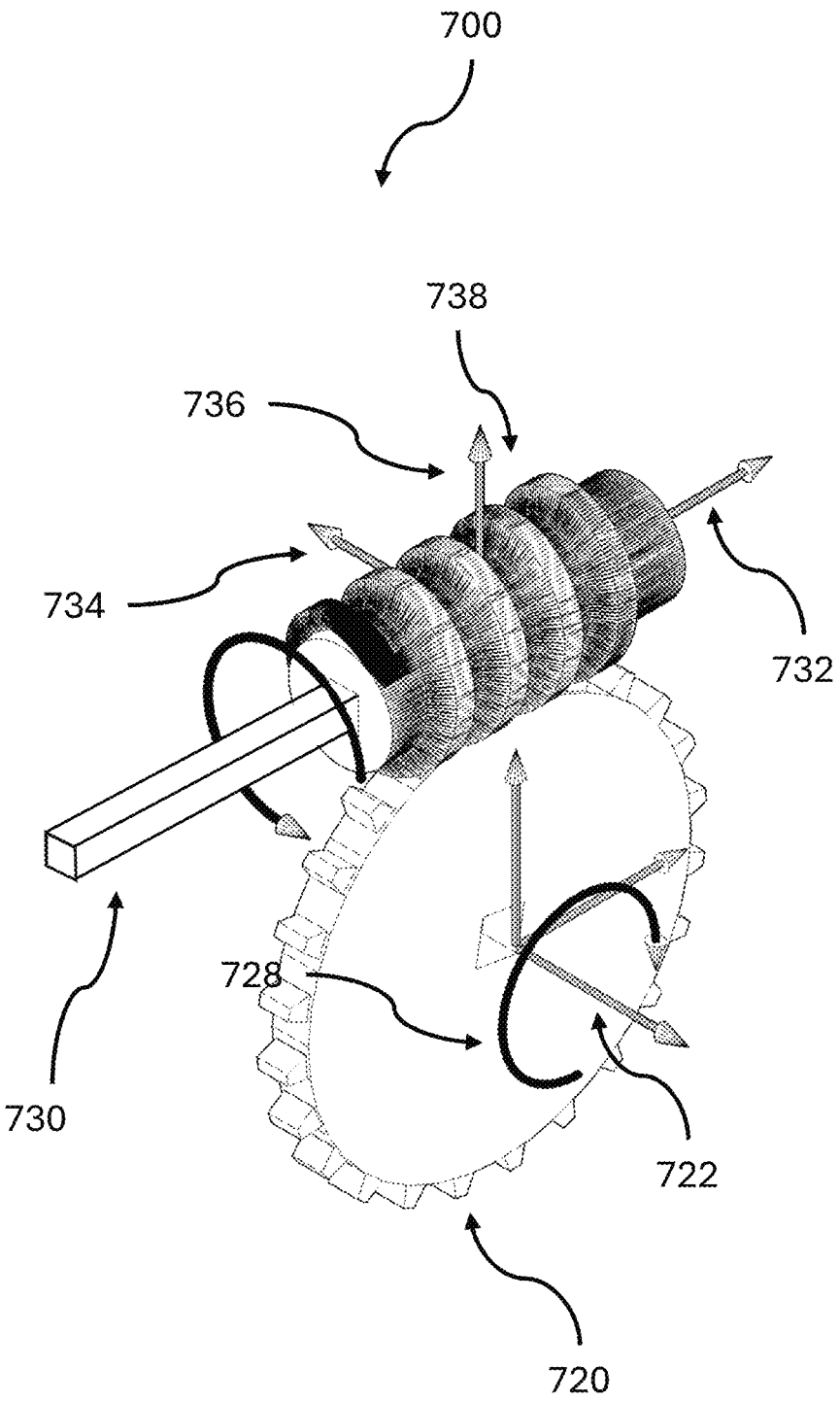
FIG. 7 illustrates a force vector diagram of an expanded view of a torque limiter according to various aspects of the present disclosure.

FIG. 7 illustrates an expanded view of a torque limiter 700 according to various aspects of the present disclosure. The torque limiter 700 may be composed of a worm gear 738 of a common shaft 730 and a spur gear 720 of the ASA 424/426. When the common shaft 730 rotates around a longitudinal direction 732 thereof, a force separating the worm gear 738 from the spur gear 720 along the direction 736 may be applied. Specifically, As torque generated by the rotations of the common shaft 730 is applied to the spur gear 720, the resistance torque 728 is applied to the worm gear 738 in a direction to separate the worm gear 738 in the upward direction 736. As the resistance torque 728 is increased, such resistance torque 728 allows the worm gear 738 to lift away from the spur gear 720 until there is enough separation for the worm gear 738 to start slipping and thus limiting the torque applied to the spur gear 720. A spring mounted bushing could provide a similar method to limit torque.

In various aspects, the worm gear 738 may have a circular shape when viewed from the direction opposite the direction 722 or perpendicular to the circular shape of the spur gear 720 so that, when the worm gear 738 mates with the spur gear 720, the helical threads of the worm gear 738 mate well with the teeth on the circular shape of the spur gear 720. The pressure angle of the helical threads is the angle at which the helical threads of the worm gear 738 exerts force on the teeth of the spur gear 720. The pressure angle of the worm gear 738 may be adjusted so that, when a certain level of the resistance torque 728 is exerted on the worm gear 738 from the spur gear 720, the worm gear 738 easily slips away from the spur gear 720. The pressure angle of the worm gear 738 may be greater than or equal to 20°, 25°, or 30°.

Figure 8A:
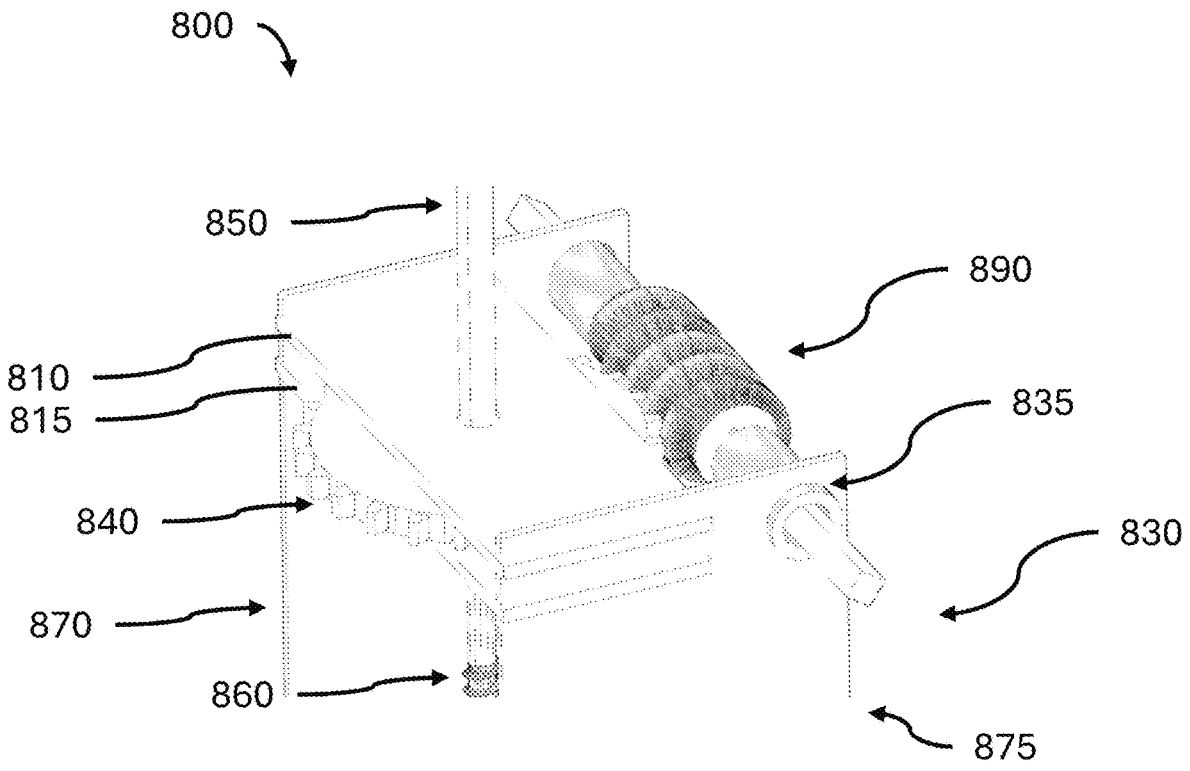
FIG. 8A illustrates a perspective view of a torque limiter in low torque in an adjoining screw assembly (ASA) according to various aspects of the present disclosure.
Figure 8B:
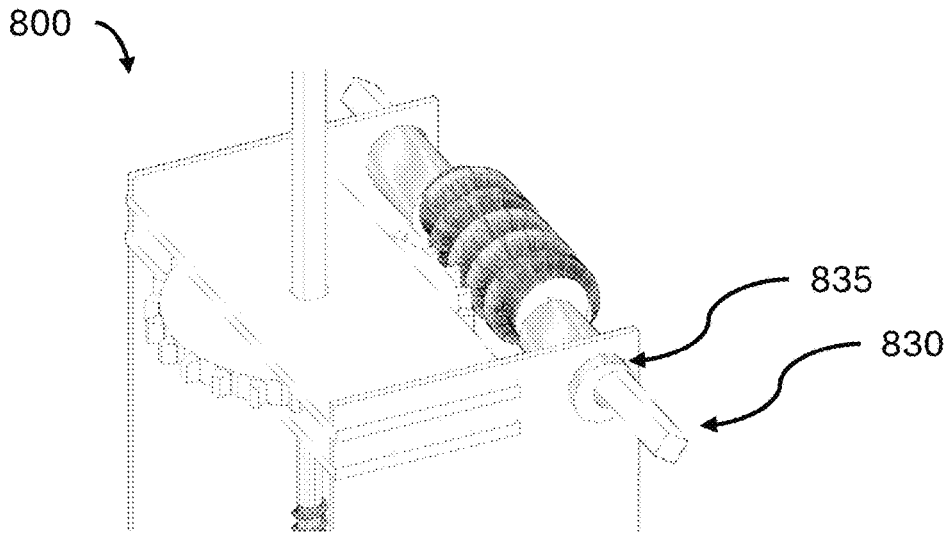
FIG. 8B illustrates a perspective view of a torque limiter in high torque in an ASA according to various aspects of the present disclosure.

The torque limiter mechanism may be further illustrated in FIGS. 8A and 8B. An ASA 800 may include a screw 860, a screw shaft 850, and a spur gear 840. Further, the ASA 800 may include an upper plate 810 and a retainer 815, of which both may provide a structural support for the spur gear 840 so that the spur gear 840 stays at the same position while rotating. The upper plate 810 includes an opening, through which the screw shaft 850 can pass. Likewise, the retainer 815 also includes a corresponding opening, through which the screw shaft 850 can pass. The spur gear 840 may be mechanically connected to the screw shaft 850 so that, when the spur gear 840 rotates, the screw shaft 850 likewise rotates. The gear ratio between the worm gear 890 and the spur gear 840 may be 4:1, 5:1, 10:1, 20:1, 24:1, or any other ratio, which can ensure sufficient torque transfer to the spur gear 840 so as to provide a sufficient penetration force to the screw 860.

The bottom of the screw shaft 850 may be fixedly connected to the head of the screw 860. While the common shaft 830 rotates, the combination of the screw 860 and the screw shaft 850 may move up or down based on the rotational direction. While the screw shaft 850 moves up and down, the mechanical coupling between the screw shaft 850 and the spur gear 840 is maintained. The retainer 815 prevents the spur gear 840 from moving longitudinally with respect to the screw shaft 850.

Two side plates 870 and 875 may form the cage 820 and the upper plate 810 and retainer 815 are fixedly positioned between two side plates 870 and 875. The common shaft 830 may pass through an opening in the two side plates 870 and 875 through an elastic bushing 835 and the position of the common shaft 830 is maintained within the opening of the two side plates 870 and 875. The common shaft 830 may include the worm gear 890 between the two side plates 870 and 875, and the worm gear 890 may mesh with the spur gear 840. The cage 820 may include the upper plate 810, the bottom plate (which is not shown), and the left and right side plates 870 and 875.

While the screw 860 is moving down to penetrate into a dimensional lumber, the mechanical coupling between the spur gear 840 and the worm gear 890 may be firmly maintained, as illustrated in FIG. 8A. When the screw 860 reaches its farthest position, the spur gear 840 is less likely rotating due to non-moving screw 860. The non-moving screw 860 exerts resistant force against the worm gear 890 in a direction separating from the spur gear 840, and the elastic bushing 835 yields, allowing the worm gear 890 to lift away from the spur gear 840 until there is enough separation for the worm gear 890 to start slipping and thus limiting the torque applied to driving the screw 860, as illustrated in FIG. 8B. In other words, the worm gear 890 and the common shaft 830 may be loosely connected to each other when approaching high torque conditions.

In an aspect, when the worm gear 890 and the common shaft 830 is fixedly connected to each other, the common shaft 830 may move to the separating direction when receiving resistance force from the spur gear 840. In another aspect, other types of gears may be employed for the translation of rotational directions.

The worm gear 890 has a helical thread, which has two contact faces mating with two contact faces of the teeth of the spur gear 840. The face angle may be adjusted on each face to provide different torque limits. For example, when the worm gear 890 rotates in a fastening direction for the screw 860, the torque limiter works to prevent over-torquing of the screws, while, when the worm gear 890 rotates in a loosening direction for the screw 860, the torque limiter may provide some additional torque, when removing the screw, ensuring it is not stuck. In this regard, the face angle in the fastening direction may be greater than the face angle in the loosening direction.

Figure 9:
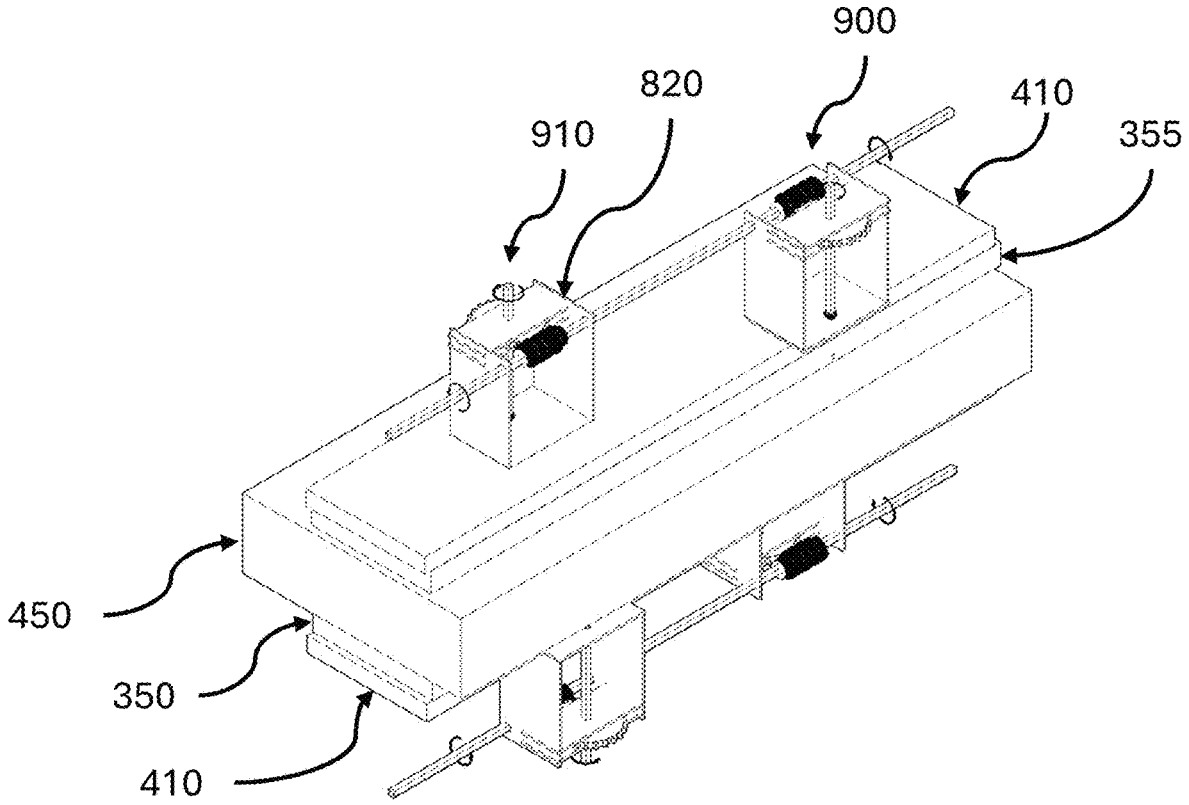
FIG. 9 illustrates a graphical illustration of two different ASAs in two different positions and the adjoining of an adjacent modular panel according to various aspects of the present disclosure.

Now returning to positions of the ASAs, FIG. 9 illustrates two different ASAs 900 and 910 in two different positions according to various aspects of the present disclosure. The ASAs 900 and 910 may be positioned on the same side surface and connected to the same common shaft. The ASAs 900 and 910 may be positioned on the left and right, (such that their respective worm gears threads rotate the spur gears the same direction), respectively, with respect to the longitudinal axis of the common shaft. Thus, when two adjacent modular panels are tightly adjoined via the dimensional lumber 450, screws from the both modular panels may be aligned in two lines with respect to the longitudinal axis of the common shaft. Specifically, as illustrated in FIG. 9, the top modular panel has the ASA 900 in the right side and the ASA 910 in the left side with respect to the longitudinal direction of the common shaft from the top right to the bottom left direction, the bottom modular panel has one ASA in the left side and another ASA in the right side with respect to the longitudinal direction of the common shaft from the top right to the bottom left direction.

Figure 10:
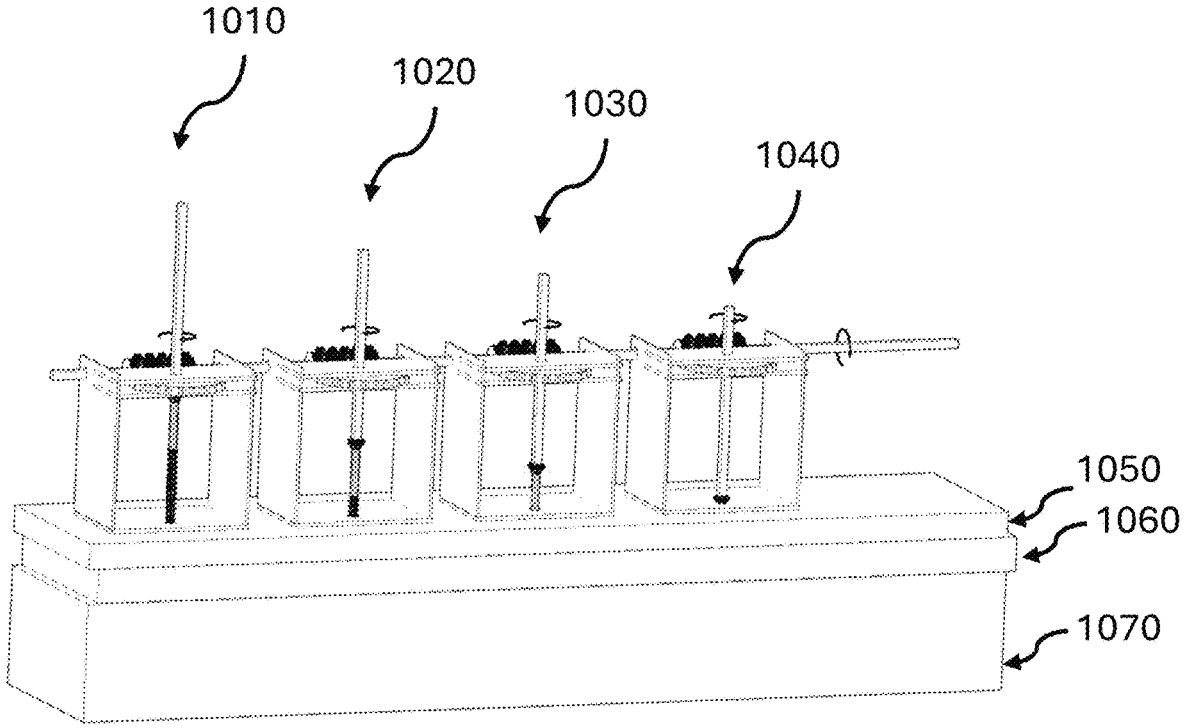
FIG. 10 illustrates a graphical illustration in steps showing how screws penetrate via a gear mechanism according to various aspects of the present disclosure.

FIG. 10 illustrates a graphical illustration showing how screws penetrate via an ASA gear mechanism according to various aspects of the present disclosure. When the common shaft starts rotating along the longitudinal or horizontal direction of the common shaft, the gear mechanism translates the rotations of the common shaft in the horizontal direction into rotations around the vertical direction or the longitudinal direction of the screw. 1010 shows that the screw starts rotating and penetrating, 1020 shows that only a small portion of the thread portion of the screw is left in the screw, 1030 shows that all of the threaded portions disappear from the screw, and 1040 shows that penetration of the screw is complete and only the head portion is left. The screw penetrates through the GASA mounting strip 1050, through the side of the truss box enclosure 1060, into the dimensional lumber 1070.

It is noted that ASAs are all positioned inside the modular panel. That means a worker is not able to see how much the screw penetrates into the dimensional lumber 1070 (e.g., 2"×6", 2"×8", 2"×10", etc.) in turn attached to the adjacent modular panel. Further, the worker is unable to see whether all screws complete penetration when two or more ASAs are connected to the common shaft. The present disclosure provides a way to address this issue.

E. Aspects of Penetration Measuring Device

Figure 11:
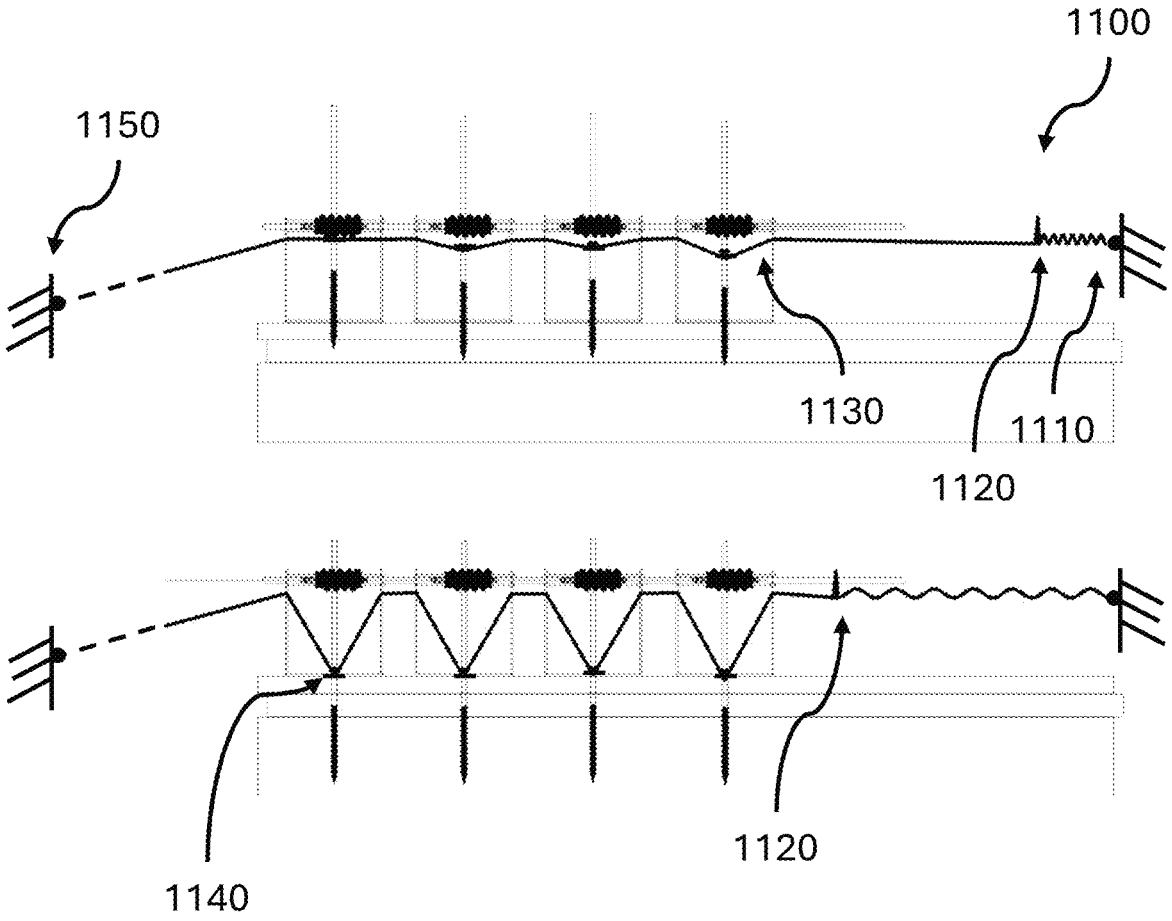
FIG. 11 illustrates graphical illustrations of a sensor device measuring penetration of screws according to various aspects of the present disclosure.

FIG. 11 illustrates a penetration measuring device 1100 according to various aspects of the present disclosure. The penetration measuring device 1100 may include an elastic spring portion 1110, a penetration meter indicator 1120, and a connecting portion filament 1130, where each penetrating screw head has a guide washer 1140. One end of the penetration measuring device 1100 or the end of the elastic spring portion 1110 may be affixed to one side surface 1150 so that the penetration meter indicator 1120 may be retracted when all screws are loose from the adjacent modular panel.

The connecting portion filament 1130 may be connected to the guide washer 1140 under the head of each screw. Specifically, the connecting portion filament 1130 may pass through an opening of the ASA cage side plates. The connecting portion filament 1130, for example, may be made of a fishing line. When the common shaft is connected to two or more ASA cages, the connecting portion filament 1130 may pass through the opening of each side plate of each cage. The other end of the penetration measuring device 1100 or the end of the connecting portion filament 1130 may be affixed to another side surface 1150, which is opposite to the side surface, to which the end of the elastic spring portion 1110 is affixed.

As screws penetrates the dimensional lumber attached to the adjacent modular panel, the connecting portion filament 1130 is pulled down following the heads of the screws. As the connecting portion filament 1130 is pulled down, the elastic spring portion 1110 is also pulled and expanded, thereby moving the penetration meter indicator 1120 toward the first cage. In an aspect, the screw may have a guide washer 1140 below the head, and the connecting portion filament 1130 is positioned between the head and the guide washer 1140. Thus, when the screw is loosed, the connecting portion filament 1130 may be pulled up based on the guide washer 1140, and the elastic spring portion 1110 may pull the penetration meter indicator 1120 toward the side surface, to which the elastic spring portion 1110 is affixed, and pull the connecting portion filament 1130 up toward the worm gear.

The penetration meter indicator 1120 will be sensed by an external detector, which may be similar to a stud finder, which can find the location of a stud, or a wire detector, which can find a wire behind the wall. The external detector can locate the position of the penetration meter indicator 1120. Based on the location of the penetration meter indicator 1120, the worker may be able to determine the combined penetration of the screws, thereby enabling confidence in the blind adjoining of the modular panels. In this regard, a full penetration position may be predetermined and indicated through the front surface of each modular panel so that, when the penetration meter indicator 1120 is sensed at the full penetration position, all screws are believed to complete the full penetration.

After confirmation of full penetration of all screws, the four small penetration holes (e.g., the penetration holes 510 of FIG. 5) may be patched with a plug, filler or caulk.

It is contemplated that various combinations or subcombinations of the specific features and aspects of the embodiments disclosed above may be made and still fall within one or more of the embodiments. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed embodiments. Thus, it is intended that the scope of the present disclosure herein disclosed should not be limited by the particular disclosed embodiments described above. Moreover, while the present disclosure is susceptible to various modifications, and alternative forms, specific examples thereof have been shown in the drawings and are herein described in detail. It should be understood, however, that the present disclosure is not to be limited to the particular forms or methods disclosed, but to the contrary, the present disclosure is to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication.

F. Term Definition

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "screw" includes one, two, or more screws.

Numbers, percentages, ratios, or other values stated herein may include that value, and also other values that are about or approximately the stated value, as would be appreciated by one of ordinary skill in the art. As such, all numeric values may be optionally modified by including the term "about" in a claim. Such values may thus include an amount or state close to the stated amount or state that still performs a desired function or achieves a desired result. A stated value should therefore be interpreted broadly enough to encompass values that are at least close enough to the stated value to perform a desired function or achieve a desired result, and/or values that are round to the stated value. The stated values include at least the variation to be expected in a typical manufacturing or other process, and may include values that are within 10%, within 5%, within 1%, etc. of a stated value. Similarly, this would apply to nominal designations, such as for dimensional lumber, e.g. where a 2 by 4 is 1.5 by 3.5 inches, etc.

Some ranges may be disclosed herein. Additional ranges may be defined between any values disclosed herein as being exemplary of a particular parameter. All such ranges are contemplated and within the scope of the present disclosure.

Use of the term "between" in conjunction with a given set of values (e.g., "between 2 and 10") is meant to be inclusive of the endpoints of such range (e.g., including both 2 and 10).

For purposes of the present disclosure and appended claims, the conjunction "or" is to be construed inclusively (e.g., "an apple or an orange" would be interpreted as "an apple, or an orange, or both"; e.g., "an apple, an orange, or an avocado" would be interpreted as "an apple, or an orange, or an avocado, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives.

G. Example Implementations

In view of the foregoing, the present disclosure relates, for example, and without being limited thereto, to the following aspects.

Clause 1. A modular panel having a box shape for forming a wall, floor, or roof section for constructing a building, comprising: a ganged adjoining screw assembly (GASA) fixedly positioned inside of the modular panel and positioned on at least one side surface of the modular panel, the GASA comprising: a plurality of adjoining screw assemblies (ASAs), each ASA having a screw, configured to penetrate the at least one side surface when rotated in one direction, and fixedly attached to a top portion of the screw and allowing rotational movements of the screw only inside the ASA; and a torque limiting device configured to prevent overdriving the screw; and a penetration measuring device configured to measure an amount of penetration of the screw, wherein the modular panel forms chase-ways inside thereof for wires and pipes.

Clause 2. The modular panel according to any preceding clause, wherein the modular panel is coated with a fire retardant material.

Clause 3. The modular panel according to any preceding clause, wherein the inside of the modular panel is coated with a vapor seal.

Clause 4. The modular panel according to any preceding clause, wherein a portion at a predetermined position in the modular panel is used to access the chase-ways, when the portion is cut out.

Clause 5. The modular panel according to any preceding clause, further comprising: a radio frequency identification (RFID) tag fixedly attached in the modular panel and having information about a serial number and manufacturing information of the modular panel.

Clause 6. The modular panel according to any preceding clause, further comprising: a boxed truss system providing structural support for the modular panel.

Clause 7. The modular panel according to any preceding clause, wherein exterior faces of the modular panel are coated with exterior paint, stucco, siding or other waterproof material suitable for outdoor environment.

Clause 8. The modular panel according to any preceding clause, wherein interior faces of the modular panel are coated with a paint finish.

Clause 9. The modular panel according to any preceding clause, wherein the ASA further includes a spur gear or worm gear.

Clause 10. The modular panel according to any preceding clause, further comprising left, right, top, bottom, front, and back sides.

Clause 11. The modular panel according to any preceding clause, wherein one or more GASAs are fixedly positioned on each of the left, right, top, and bottom sides.

Clause 12. The modular panel according to any preceding clause, wherein a penetration hole is formed on an interior face of the modular panel perpendicular to the at least one side surface, and wherein a rotating tool is to be inserted through the penetration hole and is configured to mate with a common shaft drive assembly, thereby rotating a common shaft.

Clause 13. The modular panel according to any preceding clause, wherein, when the common shaft is rotated along a longitudinal axis of the common shaft, by the rotations of the rotating tool in turn cause the ASA to rotate along a longitudinal axis of the screw.

Clause 14. The modular panel according to any preceding clause, wherein a portion of the common shaft, which mates with the ASA, has gear structure that translates the rotations of the common shaft into rotations of the screw along the longitudinal axis of the screw.

Clause 15. The modular panel according to any preceding clause, wherein, the more the screw completes penetration, the less torque the torque limiting device provides from the common shaft drive assembly to the screw.

Clause 16. The modular panel according to any preceding clause, further comprising: the common shaft drive assembly, when the rotating tool is inserted into the penetration hole, mates with the common shaft drive assembly, and translates rotations of the rotating tool to rotations of the common shaft.

Clause 17. The modular panel according to any preceding clause, wherein the common shaft is mechanically connected with an ASA, which is positioned within the GASA and translates rotations of the common shaft into rotations of the screw.

Clause 18. The modular panel according to any preceding clause, wherein the torque limiter is configured to disengage from a common shaft, when the screw completes penetration.

Clause 19. The modular panel according to any preceding clause, wherein the penetration measuring device is connected to a top portion of the screw and provides an indication about a penetration depth of the screw.

Clause 20. A modular section for constructing a building, comprising: a plurality of modular panels connected to each other to form a wall, floor, or roof section, wherein each modular panel comprises: a plurality of ganged adjoining screw assemblies (GASAs) fixedly positioned inside of the modular panel and positioned on at least one side surface within the modular panel, each GASA comprising: a plurality of adjoining screw assemblies (ASAs), each ASA having a screw, configured to penetrate the at least one side surface when rotated in one direction, and fixedly attached to a top portion of the screw and allowing rotational movements of the screw only inside the ASA; and a torque limiting device configured to prevent over driving the screw; and a penetration measuring device configured to measure an amount of penetration of the screw, wherein each modular panel contains chase-ways inside thereof for wires and pipes, and wherein adjacent modular panels facing each other on respective side surfaces are fixedly connected to each other by screws of the GASA positioned on the respective surfaces.

In the foregoing specification, the present disclosure has been described with reference to specific exemplary embodiments thereof. It will be evident that various modifications may be made thereto without departing from the broader spirit and scope of the present disclosure as set forth in the following claims. The description and drawings are, accordingly, to be regarded in an illustrative sense rather than a restrictive sense.

What is claimed is:

1. A modular panel having a box shape for forming a wall, floor, or roof section for constructing a building, comprising:

a ganged adjoining screw assembly (GASA) fixedly positioned inside of the modular panel and positioned on at least one side surface of the modular panel, the GASA comprising:

a plurality of adjoining screw assemblies (ASAs), each ASA having a screw, configured to penetrate the at least one side surface when rotated in one direction, and fixedly attached to a top portion of the screw and allowing rotational movements of the screw only inside the ASA; and a torque limiting device configured to prevent overdriving the screw; and a penetration measuring device configured to measure an amount of penetration of the screw, wherein the modular panel forms chase-ways inside thereof for wires and pipes.

2. The modular panel according to claim 1, wherein the modular panel is coated with a fire retardant material.

3. The modular panel according to claim 1, wherein the inside of the modular panel is coated with a vapor seal.

4. The modular panel according to claim 1, wherein a portion at a predetermined position in the modular panel is used to access the chase-ways, when the portion is cut out.

5. The modular panel according to claim 1, further comprising:

a radio frequency identification (RFID) tag fixedly attached in the modular panel and having information about a serial number and manufacturing information of the modular panel.

6. The modular panel according to claim 1, further comprising:

a boxed truss system providing structural support for the modular panel.

7. The modular panel according to claim 1, wherein exterior faces of the modular panel are coated with exterior paint, stucco, siding or other waterproof material suitable for outdoor environment.

8. The modular panel according to claim 1, wherein interior faces of the modular panel are coated with a paint finish.

9. The modular panel according to claim 1, wherein the ASA further includes a spur gear or worm gear.

10. The modular panel according to claim 1, further comprising:

left, right, top, bottom, front, and back sides.

11. The modular panel according to claim 10, wherein one or more GASAs are fixedly positioned on each of the left, right, top, and bottom sides.

12. The modular panel according to claim 1, wherein a penetration hole is formed on an interior face of the modular panel perpendicular to the at least one side surface, and wherein a rotating tool is to be inserted through the penetration hole and is configured to mate with a common shaft drive assembly, thereby rotating a common shaft.

13. The modular panel according to claim 12, wherein, when the common shaft is rotated along a longitudinal axis of the common shaft, by the rotations of the rotating tool in turn cause the ASA to rotate along a longitudinal axis of the screw.

14. The modular panel according to claim 13, wherein a portion of the common shaft, which mates with the ASA, has gear structure that translates the rotations of the common shaft into rotations of the screw along the longitudinal axis of the screw.

15. The modular panel according to claim 12, wherein, the more the screw completes penetration, the less torque the torque limiting device provides from the common shaft drive assembly to the screw.

16. The modular panel according to claim 12, further comprising:

the common shaft drive assembly, when the rotating tool is inserted into the penetration hole, mates with the common shaft drive assembly, and translates rotations of the rotating tool to rotations of the common shaft.

17. The modular panel according to claim 16, wherein the common shaft is mechanically connected with an ASA, which is positioned within the GASA and translates rotations of the common shaft into rotations of the screw.

18. The modular panel according to claim 12, wherein the torque limiter is configured to disengage from a common shaft, when the screw completes penetration.

19. The modular panel according to claim 1, wherein the penetration measuring device is connected to a top portion of the screw and provides an indication about a penetration depth of the screw.

20. A modular section for constructing a building, comprising:

a plurality of modular panels connected to each other to form a wall, roof, floor, or roof section, wherein each modular panel comprises:

a plurality of ganged adjoining screw assemblies (GASAs) fixedly positioned inside of the modular panel and positioned on at least one side surface within the modular panel, each GASA comprising:

a plurality of adjoining screw assemblies (ASAs), each ASA having a screw, configured to penetrate the at least one side surface when rotated in one direction, and fixedly attached to a top portion of the screw and allowing rotational movements of the screw only inside the ASA; and a torque limiting device configured to prevent over driving the screw; and a penetration measuring device configured to measure an amount of penetration of the screw, wherein each modular panel contains chase-ways inside thereof for wires and pipes, and wherein adjacent modular panels facing each other on respective side surfaces are fixedly connected to each other by screws of the GASA positioned on the respective surfaces.

* * * * *